US008380100B2

(12) United States Patent
Sohn

(10) Patent No.: US 8,380,100 B2
(45) Date of Patent: Feb. 19, 2013

(54) FUSING DEVICE

(75) Inventor: Won Hee Sohn, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 608 days.

(21) Appl. No.: 12/621,974

(22) Filed: Nov. 19, 2009

(65) Prior Publication Data

US 2010/0135688 A1 Jun. 3, 2010

(30) Foreign Application Priority Data

Dec. 24, 2008 (KR) ..... 10-2008-0133744

(51) Int. Cl.
*G03G 15/00* (2006.01)
*G03G 15/20* (2006.01)

(52) U.S. Cl. ..... 399/90; 399/328; 399/333

(58) Field of Classification Search ..... 399/90, 399/328, 331, 333
See application file for complete search history.

(56) References Cited

FOREIGN PATENT DOCUMENTS

| | | | |
|---|---|---|---|
| JP | 06318006 A | * | 11/1994 |
| JP | 2008262070 A | * | 10/2008 |
| KR | 10-2008-0026379 | | 3/2008 |

OTHER PUBLICATIONS

Oya (JP 2008-262070 A) JPO Machine Translation.*
English language abstract of KR 10-2008-0026379, published Mar. 25, 2008.

* cited by examiner

*Primary Examiner* — David Gray
*Assistant Examiner* — Erika J Villaluna
(74) *Attorney, Agent, or Firm* — Stanzione & Kim, LLP

(57) ABSTRACT

Disclosed is a fusing device and more particularly, is a fusing device having an improved configuration to apply voltage to a press roller to achieve an enhanced image quality. The fusing device includes a first roller configured to produce heat and a second roller configured to apply pressure on the first roller. The first roller can include a shaft configured to rotate and having a conductive material, a first member configured to surround the shaft and having a non-conductive and elastic material, a second member configured to surround the first member and having a conductive film, and a third member having a conductive material and configured to electrically connect the shaft and the second member.

20 Claims, 4 Drawing Sheets

FUSING DEVICE

CROSS-REFERENCE TO RELATED APPLICATIONS

This application claims the benefit of Korean Patent Application No. 2008-0133744, filed on Dec. 24, 2008 in the Korean Intellectual Property Office, the disclosure of which is incorporated herein by reference in its entirety.

TECHNICAL FIELD

The present disclosure generally relates to a fusing device, and more particularly, to a fusing device having an improved configuration for application of voltage to a press roller.

BACKGROUND OF RELATED ART

In an image forming apparatus, an electrostatic latent image can be formed on a photoconductor, and developed into a visible image using toner. The visible toner image can be transferred to a printing medium. Formation of an image is completed when the toner image transferred to the printing medium is fixed to the printing medium.

A fusing device can be adapted to apply heat and pressure to a printing medium to fix a toner image to the printing medium. Such a fusing device can include a heating roller to apply heat to the printing medium and a press roller to apply a predetermined amount of pressure to the printing medium. When the printing medium passes between the heating roller and the press roller, the toner image is fixed to the printing medium.

An application of voltage to the press roller of a fusing device is known to achieve some improvements in the quality of the resulting image. That is, because the toner image of the printing medium delivered to the fusing device may exhibit an electrical charge of certain polarity, a voltage may be applied to the press roller to charge the press roller with a polarity opposite to the polarity of the toner image in order for a larger proportion of the toner to be fixed on the printing medium.

SUMMARY OF THE DISCLOSURE

In accordance with one aspect of the disclosure, a fusing device may be provided to comprise a heat roller, a press roller and a connecting member. The heat roller may be configured to produce heat. The press roller may be configured to apply pressure on the heat roller, and may have a shaft about which the press roller is configured to rotate, an elastic member surrounding the shaft and a film member surrounding the elastic member. The shaft and the film member may each be electrically conductive. The elastic member may be electrically non-conductive. The connecting member may be electrically conductive, and may be configured to electrically connect the shaft and the film member.

The connecting member may have one end thereof supported by the shaft and the other end thereof supported by the elastic member.

The connecting member may comprise a first portion secured to the shaft and a second portion secured to the elastic member. The film member may be secured to the elastic member by the second portion of the connecting member.

The film member may comprise an extension portion that extends radially from an outer periphery of the press roller toward the shaft along an end surface of the elastic member. The extension portion may be secured to the end surface of the elastic member by the connecting member.

The fusing device may further comprise a spring assembly which may be configured to elastically bias the press roller toward the heat roller and to rotatably support the shaft.

The fusing device may further comprise a power supply member having a first portion that is in direct contact with the shaft and a second portion that is in direct contact with the spring assembly. The spring assembly may be electrically conductive so as to provide an electrical connection between the second portion of the power supply member and the shaft.

The first portion of the power supply member may elastically contact the rotating shaft According to another aspect of the present disclosure, a fusing device may be provided to comprise a heat roller and a press roller. The heat roller may be configured to produce heat. The press roller may be configured to apply pressure on the heat roller, and may have a shaft about which the press roller is configured to rotate, an elastic member surrounding the shaft and a film member surrounding the elastic member. The shaft and the film member may each be electrically conductive. The elastic member may be electrically non-conductive. The film member may include a main portion surrounding an outer peripheral surface of the elastic member and an extension portion that extends radially from the outer peripheral surface to the shaft and that thereby contacts the shaft.

The fusing device may further comprise a fastening member which may be arranged to secure the extension portion of the film member to the shaft.

The fusing device may further comprise a spring assembly which may be configured to elastically bias the press roller toward the heat roller and to rotatably support the shaft.

The fusing device may further comprise a power supply member which may have a first portion that is in direct contact with the shaft and a second portion that is in direct contact with the spring assembly. The spring assembly may be electrically conductive so as to provide an electrical connection between the shaft and the second portion of the power supply member.

According to yet another aspect, a fusing device for use in an image forming apparatus to fix toner on a printing medium may be provided to comprise a cylindrical roller that may be rotatable about an electrically conductive rotational shaft, and which may include an electrically conductive outer layer that defines an outer peripheral cylindrical surface of the cylindrical roller configured to contact the print medium. The cylindrical roller may further include at least one intermediate layer provided between the shaft and the electrically conductive outer layer. The at least one intermediate layer may be electrically non-conductive. A portion of the electrically conductive outer layer may extend radially from the outer peripheral surface toward the electrically conductive rotational shaft so as to define an electrical connection surface extending, at an axial end of the cylindrical roller, substantially non-parallel to the electrically conductive rotational shaft. The electrical connection surface may be electrically connected to the electrically conductive rotational shaft.

The electrical connection surface may be in a direct contact with the electrically conductive rotational shaft.

The fusing device may further comprise a fastening member disposed at the direct contact between the electrical connection surface and the electrically conductive rotational shaft to securely hold the electrically conductive outer layer and the electrically conductive rotational shaft together.

The fusing device may alternatively comprise an electrically conductive member electrically connecting the electrical connection surface with the electrically conductive rotational shaft.

A portion of the electrically conductive member may be received into both the electrically conductive outer layer and at least one intermediate layer.

The fusing device may further comprise an electrically conductive member and a support structure. The electrically conductive member may be configured to receive electrical power from a power supply. The support structure may be configured to rotatably support the electrically conductive rotational shaft.

The electrically conductive member may have a first portion in direct contact with the electrically conductive rotational shaft and a second portion in contact with the support structure. The support structure may be electrically conductive so as to provide an electrical connection between the electrically conductive member and the electrically conductive rotational shaft.

The fusing device may further comprise a heat roller configured to produce heat and arranged to opposingly face the cylindrical roller. The support structure may comprise a bearing, a bushing and an elastic member. The bearing may rotatably support the electrically conductive rotational shaft. The bushing may be coupled to the bearing to support the bearing. The elastic member may be coupled to the bushing, and may be configured to elastically bias the cylindrical roller toward the heat roller.

The second portion of the electrically conductive member may be in direct contact with the elastic member.

The first portion of the electrically conductive member may impart an elastic force on an axial end of the electrically conductive rotational shaft.

BRIEF DESCRIPTION OF THE DRAWINGS

Various aspects and advantages of the various embodiments will become apparent and more readily appreciated from the following description of the embodiments, taken in conjunction with the accompanying drawings, in which.

DETAILED DESCRIPTION OF SEVERAL EMBODIMENTS

Figure 1:
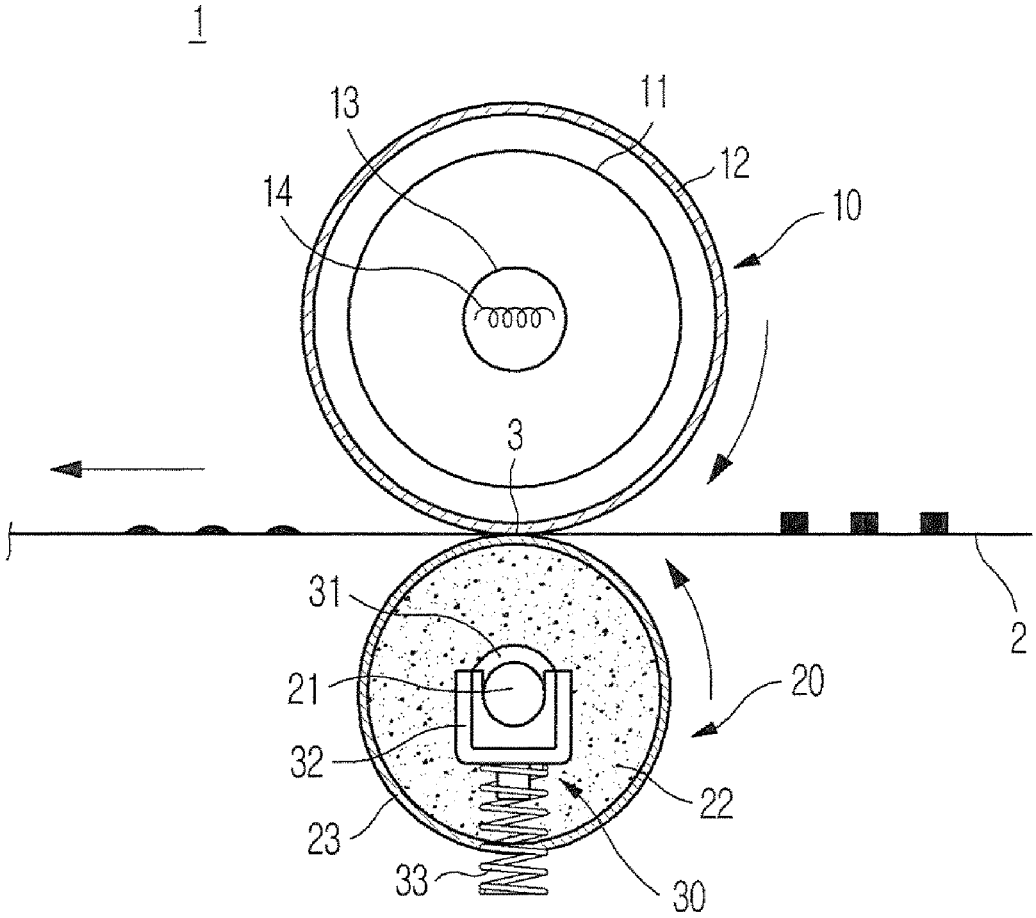
FIG. 1 is a cross-sectional view illustrating a general configuration of a fusing device according to an embodiment.

Reference will now be made in detail to several embodiments, examples of which are illustrated in the accompanying drawings, wherein like reference numerals refer to like elements throughout. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be also noted that in the drawings, the dimensions of the features are not intended to be to true scale and may be exaggerated for the sake of allowing greater understanding.

FIG. 1 is a cross-sectional view illustrating the general configuration of a fusing device according to an embodiment.

As shown in FIG. 1, the fusing device 1 according to an embodiment can include a heating roller 10 and a press roller 20 configured to press the heating roller 10 with a predetermined pressure. Both the heating roller 10 and the press roller 20 can be rotatably disposed in the fusing device 1. When the press roller 20 comes into contact with the heating roller 10 while applying a predetermined pressure thereto, a nip 3 can be created between the contact surfaces of the press roller 20 and heating roller 10. When a printing medium 2 passes through the nip 3, a toner image on the printing medium 2 can be fixed to the printing medium 2. Specifically, the heating roller 10 and press roller 20 can apply heat and pressure to the printing medium 2 passing through the nip 3 to allow the toner image to melt and to be fused to the printing medium 2.

The heating roller 10 can include a cylindrical rotator 11, a release layer 12 provided on an outer peripheral surface of the rotator 11 and a heat source, for example, a heat lamp 13 disposed in the rotator 11.

The rotator 11 can made of a conductive material, such as aluminum, for example. The rotator 11 can have a cylindrical shape and can be rotatably supported at both ends thereof by, for example, bearings (not shown). A drive device (not shown) can be provided at one end of the rotator 11 to rotate of the rotator 11.

The release layer 12 can be made of a non-conductive material. To provide the rotator 11 with the release layer 12, the outer peripheral surface of the rotator 11 can be made non-conductive via corrosion, for example, or an additional non-conductive material can be coated or can be disposed over the outer peripheral surface of the rotator 11.

The heat lamp 13 can include a heating element 14. In some embodiments, the heating element 14 can be made of a filament, such as a tungsten filament, for example. When electric power is supplied to the heating element 14, radiant heat can be produced by the heating element 14, and can be radiated to the rotator 11.

Figure 2:
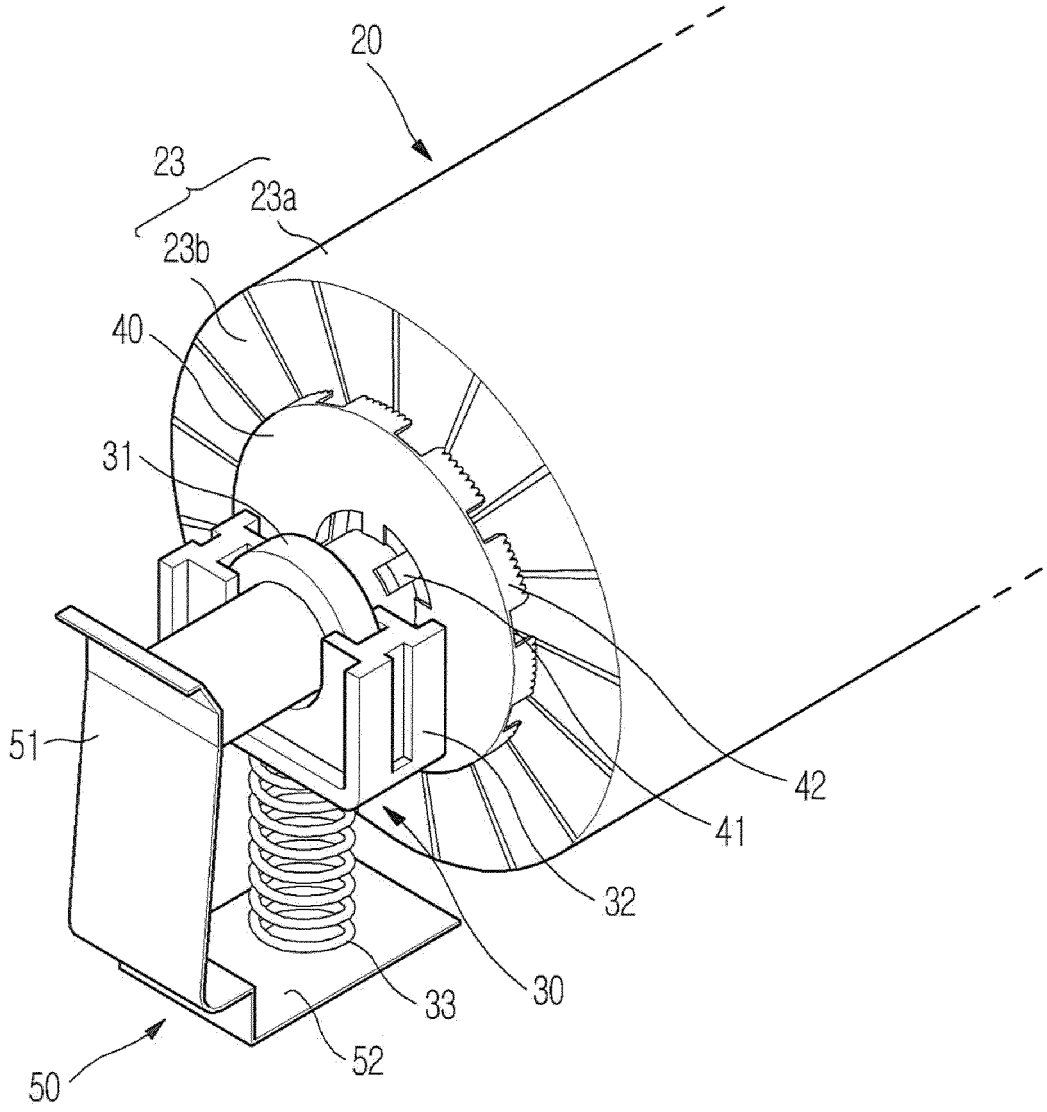
FIG. 2 is a perspective view illustrating a press roller according to an embodiment.
Figure 3:
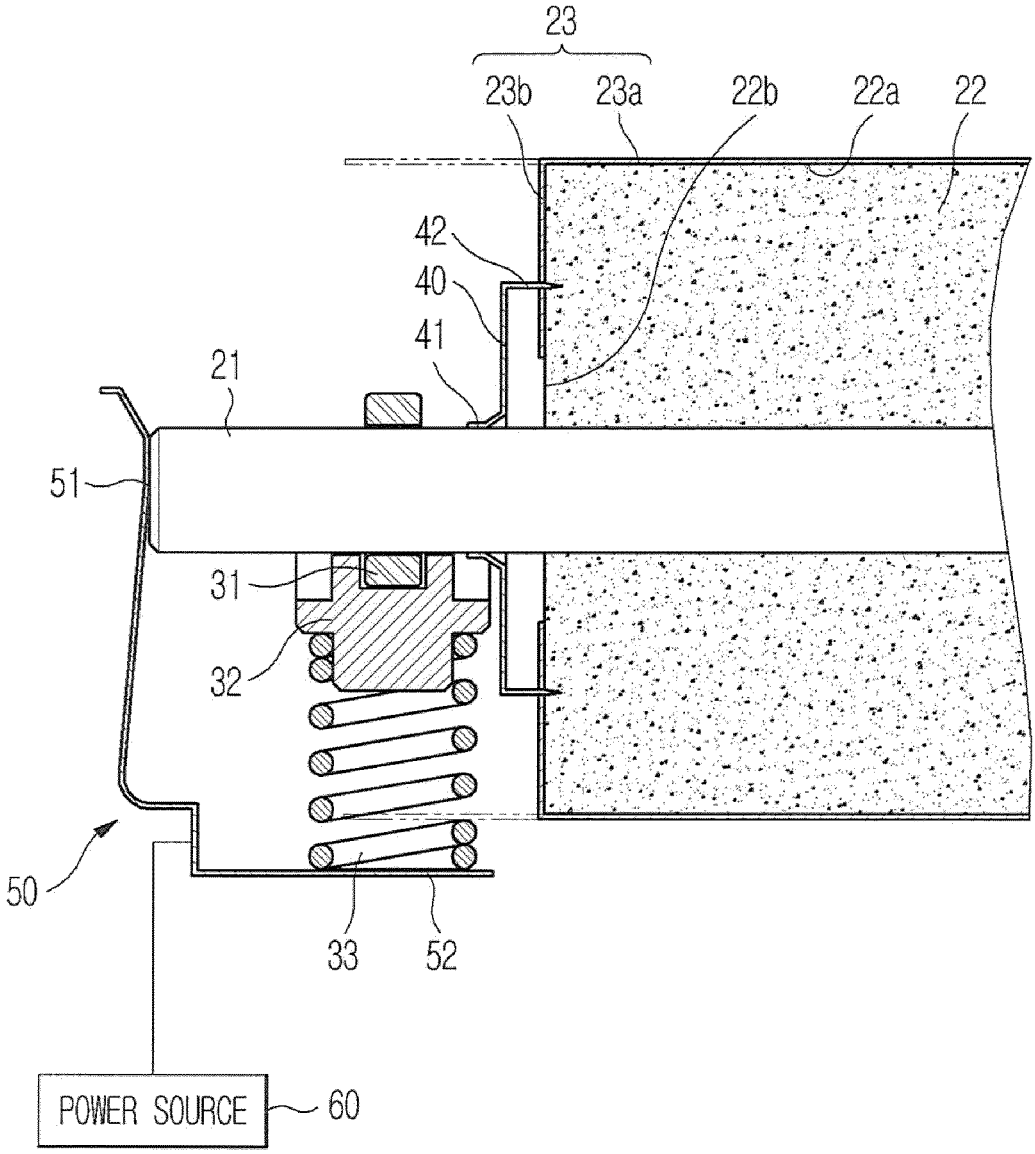
FIG. 3 is a side cross-sectional view of a press roller according to an embodiment.

FIG. 2 is a perspective view illustrating the press roller according to an embodiment. FIG. 3 is a side cross-sectional view of the press roller shown in FIG. 2.

As shown in FIGS. 1-3, the press roller 20 can include a rotating shaft 21, an elastic member 22 that can surround an outer peripheral surface of the rotating shaft 21, and a film member 23 that can surround an outer peripheral surface of the elastic member 22.

The rotating shaft 21 can be made of a conductive material, such as aluminum, steel, or other like material, for example. Both ends of the rotating shaft 21 can be rotatably supported by spring assemblies 30 such that the press roller 20 can be rotated along with the heating roller 10. When the ends of the rotating shaft 21 are rotatably supported by the spring assemblies 30, the press roller 20 can be adapted to press the heating roller 10.

Each spring assembly 30 can include a bearing 31, a bushing 32 and a spring 33. The bearing 31 can be inserted in the bushing 32, and can rotatably support the rotating shaft 21. The spring 33 can be secured to the bushing 32, and can be configured to elastically support the rotating shaft 21. According to an embodiment, the spring assembly 30 can contain a conductive resin to allow the spring 33 and the rotating shaft 21 to remain electrically connected.

The fusing device 1 can include a power supply member 50 to supply electrical power to the rotating shaft 21. The power supply member 50 can include a first supply portion 51 configured to come into direct contact with the rotating shaft 21, and a second supply portion 52 configured to come into contact with the spring 33. The first supply portion 51 can be elastically deformable to support the end of the rotating shaft 21. The second supply portion 52 can support the bottom of the spring 33. When a power source 60 (see FIG. 3) supplies electrical power to the power supply member 50, the power supply member 50 can supply the electrical power to the rotating shaft 21 directly through the first supply portion 52 or via the spring assembly 30.

The elastic member 22 of the press roller 20 can be made of a non-conductive material, such as silicone, urethane, or other like material, for example. The elastic member 22 can surround the outer peripheral surface of the rotating shaft 21, and can be insulated from the rotating shaft 21. Because of the elasticity of the elastic member 22, the nip 3 can be created between the heating roller 10 and the press roller 20 when the press roller 20 presses against the heating roller 10 assisted by the spring assembly 30. As heat and pressure are applied to the printing medium 2 passing through the nip 3, the toner image can be fixed to the printing medium 2.

The film member 23 of the press roller 20 can be made of a conductive material and can be charged upon supply of electrical power. The film member 23 can surround the outer peripheral surface of the elastic member 22, and can be insulated from the rotating shaft 21 by the elastic member 22. In one embodiment, the film member 23, which is conductive, can be connected to the rotating shaft 21, which is also conductive, thus enabling a supply of electric power from the power source 60 through the power supply member 50 and the rotating shaft 21 to the film member 23.

The film member 23 can include a main portion 23*a* configured to surround the outer peripheral surface 22*a* of the elastic member 22, and an extension portion 23*b* configured to cover an end surface 22*b* of the elastic member 22. In one example, the extension portion 23*b* can extend, by a predetermined length, from the main portion 23*a* in a radial direction of the elastic member 22. In this example, when the extension portion 23*b* is not directly connected to the rotating shaft 21, a connecting member 40 (see FIG. 3) can be provided to electrically connect the extension portion 23*b* and the rotating shaft 21 to each other.

The connecting member 40 can be configured to electrically connect the film member 23 and the rotating shaft 21 to each other. The connecting member 40 can include a first fixing portion 41 supported by the rotating shaft 21 and a second fixing portion 42 supported by the elastic member 22. The second fixing portion 42 can also serve to secure the extension portion 23*b* of the film member 23 to the end surface 22*b* of the elastic member 22.

The connecting member 40 can be made of a conductive material. The first fixing portion 41 can be configured to be elastically deformable to exhibit a desired elasticity. When the connecting member 40 is press-fitted to the rotating shaft 21, the first fixing portion 41 can be elastically supported by the rotating shaft 21. The second fixing portion 42 can have a notched distal portion suitable to be inserted into the end surface 22*b* of the elastic member 22, which is made of a material such as silicone, for example. The second fixing portion 42 of the connecting member 40 can be further coupled to the extension portion 23*b* of the film member 23, thereby serving to secure the extension portion 23*b* to the end surface 22*b* of the elastic member 22. The coupling of the second fixing portion 42 of the connecting member 40 and the extension portion 23*b* of the film member 23 can be obtained via drilling, press-fitting, compression, or other like procedure or mechanism suitable for coupling such components. Thus, when one end of the connecting member 40 is secured to the rotating shaft 21 and the other end of the connecting member 40 is secured to the end surface 22*b* of the elastic member 22 along with the extension part 23*b* of the film member 23*b*, the connecting member 40 can supply electric power to the film member 23 while being rotated along with the rotating shaft 21.

Figure 4:
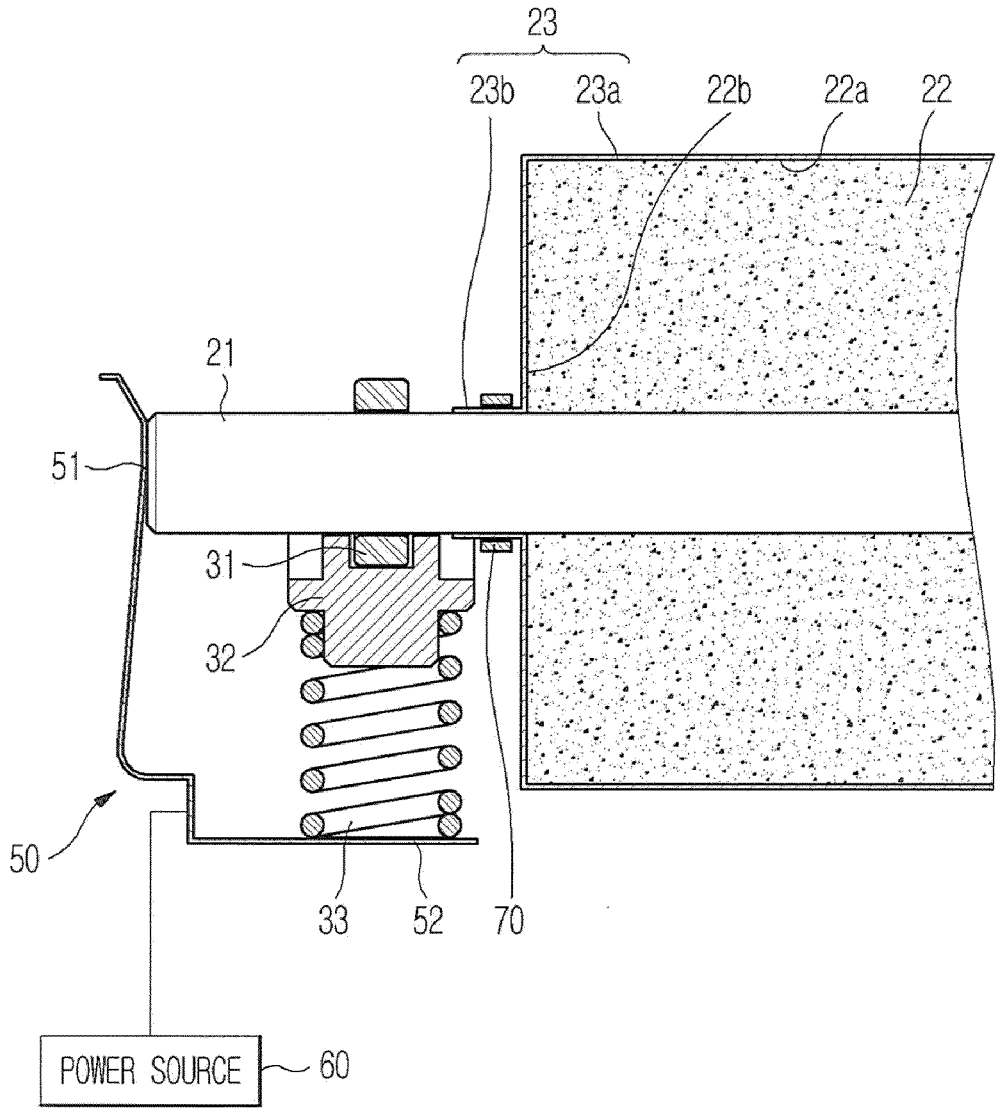
FIG. 4 is a side cross-sectional view illustrating a press roller according to another embodiment.

FIG. 4 is a side cross-sectional view illustrating a press roller according to another embodiment.

As shown in FIG. 4, the film member 23 according to an embodiment can include the main portion 23*a* surrounding the outer peripheral surface 22*a* of the elastic member 22 and the extension portion 23*b* covering the end surface 22*b* of the elastic member 22. In this embodiment, the extension portion 23*b* can extend in a radial direction of the elastic member 22 by a predetermined length, and can have a direct electrical connection to the rotating shaft 21.

In this embodiment, to keep the extension portion 23*b* secured to the rotating shaft 21, a fastening member 70 can be provided to couple the extension portion 23*b* to the rotating shaft 21. The fastening member 70 can be made of a conductive material or of a non-conductive material.

The operation of the fusing device 1 according to the various embodiments discussed above is described below with reference to FIGS. 1 through 4.

As shown in FIGS. 1 through 4, the fusing device 1 can be provided in an image forming apparatus. In addition to the fusing device 1, the image forming apparatus can include, for example, a photosensitive drum (not shown) on the surface of which an electrostatic latent image may be formed, a laser scanning unit (not shown) configured to expose the photosensitive drum to thereby form the electrostatic latent image, a developing roller (not shown) configured to develop the electrostatic latent image of the photosensitive drum into a visible developer image using developer, e.g., toner, and a transfer roller (not shown) configured to transfer the visible developer image on the surface of the photosensitive drum onto a printing medium.

In the image forming apparatus of the above configuration, as the printing medium 2 is delivered by way of the various components described above, a toner image having certain charge polarity can be transferred from the photosensitive drum to the printing medium 2. Thereafter, the printing medium 2, to which the toner image is transferred, can be delivered to the fusing device 1 where the toner image can be fixed to the printing medium 2 by heat and pressure applied to the printing medium 2 as the printing medium 2 passes through the nip 3.

The power source 60 can supply electrical power to the rotating shaft 21 via the power supply member 50. The electric power supplied to the supply member 50 can be supplied to the film member 23 connected to the rotating shaft 21 causing the film member 23 to be charged with a polarity opposite to the polarity of the toner image. By charging the film member 23 in this manner, the image quality that results from fusing the toner image to the printing medium 2 passing through the nip 3 can be improved.

As is apparent from the above description, a fusing device according to the various embodiments does not produce damage on the film member thereof such that a stable and high image quality can be realized.

Moreover, as the film member is continuously connected to a rotating shaft to assure stable voltage application, the risk of a poor quality image can be reduced or minimized.

Furthermore, using a non-conductive elastic member that is relatively inexpensive can reduce overall manufacturing costs.

Although several embodiments have been shown and described, it would be appreciated by those skilled in the art that changes may be made in these embodiments without departing from the principles and spirit of the disclosure, the scope of which is defined in the claims and their equivalents.

What is claimed is:

1. A fusing device, comprising:

a heat roller configured to produce heat;

a press roller configured to apply pressure on the heat roller, the press roller having a shaft about which the press roller is configured to rotate, an elastic member surrounding the shaft and a film member surrounding the elastic member, the shaft and the film member each being electrically conductive, the elastic member being electrically non-conductive; and a connecting member that is electrically conductive, the connecting member being configured to electrically connect the shaft and the film member, the film member comprising an extension portion that extends radially from an outer periphery of the press roller toward the shaft along an end surface of the elastic member, the extension portion being secured to the end surface of the elastic member by the connecting member.

2. The fusing device according to claim 1, wherein the connecting member has one end thereof supported by the shaft and the other end thereof supported by the elastic member.

3. The fusing device according to claim 1, wherein the connecting member comprises a first portion secured to the shaft and a second portion secured to the elastic member, and wherein the film member is secured to the elastic member by the second portion of the connecting member.

4. The fusing device according to claim 1, further comprising:

a spring assembly configured to elastically bias the press roller toward the heat roller and to rotatably support the shaft.

5. The fusing device according to claim 4, further comprising:

a power supply member having a first portion that is in direct contact with the shaft and a second portion that is in direct contact with the spring assembly, the spring assembly being electrically conductive so as to provide an electrical connection between the second portion of the power supply member and the shaft.

6. The fusing device according to claim 5, wherein the first portion of the power supply member elastically contacts the shaft.

7. A fusing device, comprising:

a heat roller configured to produce heat; and a press roller configured to apply pressure on the heat roller, the press roller having a shaft about which the press roller is configured to rotate, an elastic member surrounding the shaft and a film member surrounding the elastic member, the shaft and the film member each being electrically conductive, the elastic member being electrically non-conductive, wherein the film member includes a main portion surrounding an outer peripheral surface of the elastic member and an extension portion that extends radially from the outer peripheral surface to the shaft and that thereby contacts the shaft.

8. The fusing device according to claim 7, further comprising:

a fastening member arranged to secure the extension portion of the film member to the shaft.

9. The fusing device according to claim 7, further comprising:

a spring assembly, configured to elastically bias the press roller toward the heat roller and to rotatably support the shaft.

10. The fusing device according to claim 9, further comprising:

a power supply member having a first portion that is in direct contact with the shaft and a second portion that is in direct contact with the spring assembly, the spring assembly being electrically conductive so as to provide an electrical connection between the shaft and the second portion of the power supply member.

11. A fusing device for use in an image forming apparatus to fix toner on a printing medium, comprising:

a cylindrical roller rotatable about an electrically conductive rotational shaft, the cylindrical roller including an electrically conductive outer layer that defines an outer peripheral cylindrical surface of the cylindrical roller configured to contact the print medium, the cylindrical roller further including at least one intermediate layer provided between the shaft and the electrically conductive outer layer, the at least one intermediate layer being electrically non-conductive, wherein a portion of the electrically conductive outer layer extends radially from the outer peripheral surface toward the electrically conductive rotational shaft so as to define an electrical connection surface extending, at an axial end of the cylindrical roller, substantially non-parallel to the electrically conductive rotational shaft, the electrical connection surface being electrically connected to the electrically conductive rotational shaft.

12. The fusing device of claim 11, wherein the electrical connection surface is in a direct contact with the electrically conductive rotational shaft.

13. The fusing device of claim 12, further comprising:

a fastening member disposed at the direct contact between the electrical connection surface and the electrically conductive rotational shaft to securely hold the electrically conductive outer layer and the electrically conductive rotational shaft together.

14. The fusing device of claim 11, further comprising:

an electrically conductive member electrically connecting the electrical connection surface with the electrically conductive rotational shaft.

15. The fusing device of claim 14, wherein a portion of the electrically conductive member is received into both the electrically conductive outer layer and at least one intermediate layer.

16. The fusing device of claim 11, further comprising:

an electrically conductive member configured to receive electrical power from a power supply; and a support structure configured to rotatably support the electrically conductive rotational shaft, wherein the electrically conductive member has a first portion in direct contact with the electrically conductive rotational shaft and a second portion in contact with the support structure, the support structure being electrically conductive so as to provide an electrical connection between the electrically conductive member and the electrically conductive rotational shaft.

17. The fusing device of claim 16, further comprising:

a heat roller configured to produce heat and arranged to opposingly face the cylindrical roller, wherein the support structure comprises:

a bearing rotatably supporting the electrically conductive rotational shaft;

a bushing coupled to the bearing to support the bearing; and an elastic member coupled to the bushing and configured to elastically bias the cylindrical roller toward the heat roller.

18. The fusing device of claim 17, wherein the second portion of the electrically conductive member is in direct contact with the elastic member.

19. The fusing device of claim 16, wherein the first portion of the electrically conductive member imparts an elastic force on an axial end of the electrically conductive rotational shaft.

20. An image forming apparatus having a fusing device, the fusing device comprising:

a heat roller configured to produce heat;

a press roller configured to apply pressure on the heat roller, the press roller having a shaft about which the press roller is configured to rotate, an elastic member surrounding the shaft and a film member surrounding the elastic member, the shaft and the film member each being electrically conductive, the elastic member being electrically non-conductive; and a connecting member that is electrically conductive, the connecting member being configured to electrically connect the shaft and the film member, wherein the film member comprises an extension portion that extends radially from an outer periphery of the press roller toward the shaft along an end surface of the elastic member, the extension portion being secured to the end surface of the elastic member by the connecting member.

* * * * *